United States Patent [19]

Bynum

[11] Patent Number: 4,677,368

[45] Date of Patent: Jun. 30, 1987

[54] PRECISION THERMAL CURRENT SOURCE

[75] Inventor: Byron G. Bynum, Tempe, Ariz.

[73] Assignee: Motorola, Inc., Schaumburg, Ill.

[21] Appl. No.: 915,481

[22] Filed: Oct. 6, 1986

[51] Int. Cl.[4] ..... G05F 3/30

[52] U.S. Cl. ..... 323/311; 323/313; 323/315; 323/907; 330/256

[58] Field of Search ..... 323/311-316, 323/907; 330/256

[56] References Cited

U.S. PATENT DOCUMENTS

| | | | |
|---|---|---|---|
| 4,157,493 | 6/1979 | Monticelli | 323/907 |
| 4,460,865 | 7/1984 | Bynum et al. | 323/907 |
| 4,603,290 | 7/1986 | Shinomiya | 323/907 |

FOREIGN PATENT DOCUMENTS

| | | | |
|---|---|---|---|
| 140677 | 5/1985 | European Pat. Off. | 323/907 |
| 66128 | 4/1983 | Japan | 323/315 |

*Primary Examiner*—William H. Beha, Jr.
*Attorney, Agent, or Firm*—Michael D. Bingham

[57] ABSTRACT

A circuit that develops a current having a predetermined temperature coefficient includes a pair of transistors which are supplied equal collector currents but which are operated at different current densities to produce a difference voltage between the emitters thereof that has a predetermined temperature coefficient. A third transistor is biased to sink a collector current the value of which is set by the ratio of the difference voltage to the value of a first resistor which is coupled between the collector and base of the third transistor. A second resistor can be coupled between the base and emitter of the third transistor to an output of the circuit whereby the current flowing from the output has a net temperature coefficient that is determined by the ratio of the value of the first resistor to the value of the second resistor.

17 Claims, 3 Drawing Figures

PRECISION THERMAL CURRENT SOURCE

BACKGROUND OF THE INVENTION

This invention relates to current supply circuits and, more particularly, to integrated circuits (IC) capable of producing currents having regulated magnitudes and predetermined temperature characteristics.

There are many circuit and system applications that require current supplies or sources for providing currents having predetermined temperature coefficients (TC) and regulated magnitudes which are independent of supply voltage. More particularly, it is sometimes desirable to utilize a current supply circuit providing a current with a magnitude that has a positive TC that varies directly with absolute temperature. The current can be exploited to cancel the negative TC inherent in the PN junctions of a differential pair of transistors, for instance, so as to enable the gain of a differential amplifier comprising the differential pair of transistors to remain substantially constant with temperature changes. Since IC's generally can include many such differential amplifiers, it may require a current supply circuit of the above described type that can provide a plurality of such currents each having a predetermined magnitude and temperature coefficient associated therewith. Another use for such thermal current sources is in conjunction with other circuitry to provide a regulated output voltage having a known TC. For example, the thermal current can be utilized to produce a voltage across a resistor having a positive TC which is then placed in series with the negative TC base-to-emitter voltage of a NPN transistor to provide a zero TC output voltage. These types of voltage regulators are sometimes referred to by those skilled in the art as bandgap voltage regulators.

In general these prior art thermal current sources utilize a pair of interconnected NPN transistors which are operated at different current densities to produce a base-to-emitter voltage difference therebetween which has a positive TC. The voltage difference is used to set the current in the emitter of one of the transistors which varies with temperature in the same manner as the difference voltage. This thermal current then establishes a thermal collector current through the transistor that can be utilized as mention above.

However, a problem exist in most, if not all, of these types of thermal current sources which relates to setting the current in the emitter of the transistor. Since the emitter current also includes the base current of the transistor whereas the collector current does not, there exist an error therebetween known as beta or alpha errors, as understood. Another source of error in prior art circuits arises if the collector-emitter voltages of the two transistors are not well matched. In this case, variations in the power supply voltage can produce errors in the output current. Moreover, since an output current is typically taken at the collector of one of the two transistors, the collector currents become unequal. Consequently the prior art reference circuits tend to function improperly when required to drive multiple output loads.

Hence, a need exists for an improved integrated thermal current source circuit that overcomes the problems of prior art thermal current source circuits of the type described above.

SUMMARY OF THE INVENTION

Accordingly, it is an object of the present invention to provide an improved thermal current source circuit.

It is another object of the present invention to provide a circuit for producing a current having a regulated magnitude and temperature coefficient and which is suited to be fabricated in integrated circuit form.

Still another object is to provide a circuit for deriving a current the magnitude of which varies in a direct relation to absolute temperature.

In accordance with the above and other objects there is provided a current supply for providing a current having a controllable TC. The current supply includes a first transistor in which a thermal current is set in the collector thereof by feedback circuitry. The thermal current is a function of a difference voltage established between the emitters of a pair of transistors operated at different current densities. The difference voltage, which has a positive TC is established by sensing the collector voltage of one of the pair of transistors and providing feedback from the feedback circuitry to render the first transistor conductive to sink collector current from the emitter of the one transistor until the currents flowing through the pair of transistors are substantially equal.

In one embodiment of the invention first and second resistors are connected between the emitters of the pair of transistors and the base of the first transistor.

It is an aspect of the invention that a third resistor is connected between the base and emitter of the first transistor to provide a current having a negative TC that can be summed with the current flowing through the first transistor at an output to provide a combined current having a positive, negative or zero TC.

DETAILED DESCRIPTION OF THE PREFERRED EMBODIMENTS

Figure 1:
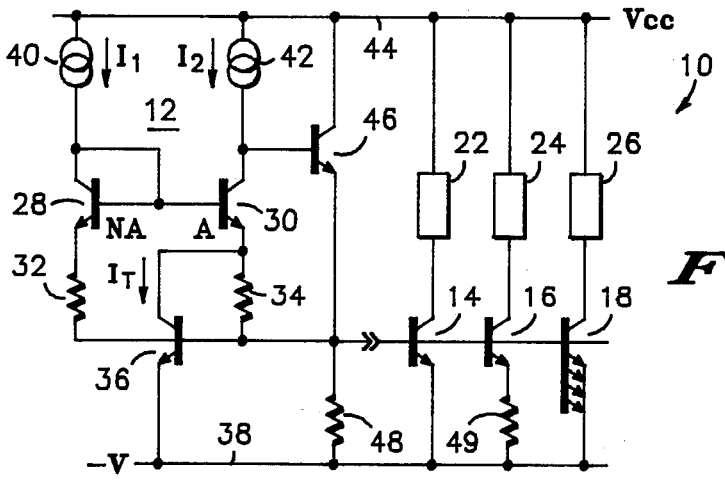
FIG. 1 is a schematic diagram of a first embodiment of the present invention.

Turning now to the Figures there are shown several embodiments of thermal current source of the present invention which are suited to be manufactured in integrated circuit form. It is understood that corresponding components described in relation to the Figures are designated by the same reference numerals. FIG. 1 illustrates the basic components and interconnection of reference cell 12 of thermal current source 10. Current source 10 is suited for providing fan out to multiple current sources such as NPN transistors 14, 16 and 18 coupled thereto at terminal 20. The collectors of the current source transistors are connected to respective current utilization circuits 22, 24 and 26 each of which requires a current having a predetermined temperature characteristic that varies with absolute temperature.

Reference cell 12 of thermal current source 10 includes a pair of NPN transistors 28 and 30 the emitters of which are respectively coupled via resistors 32 and 34 to the base of NPN transistor 36. The collector-emitter path of transistor 36 is coupled between the emitter of transistor 30 and negative supply conductor 38 to which negative or ground reference voltage −V is supplied. Transistor 28 is connected as a diode having its collector and base interconnected to the base of transistor 30. A pair of current sources 40 and 42 supply currents $I_1$ and $I_2$ to the collectors of transistors 28 and 30 respectively and are connected to power supply conductor 44 to which a positive operating voltage $V_{cc}$ is supplied. Feedback is provided to the base of transistor 36 by buffer NPN transistor 46 which has its base coupled to the collector of transistor 30 and its collector-emitter path coupled between conductor 44 and output node 20 (to the base of transistor 36) in series with resistor 48 to negative supply conductor 38.

The concept of the present invention consists of (1) developing a difference voltage having a positive temperature coefficient (TC) and (2) utilizing the difference voltage to set the current that flows in the collector of transistor 36 wherein the collector current has a magnitude that varies with absolute temperature. Transistor 36 then can be used to bias multiple current source transistors 14, 16, 18 etc. By setting the thermal current in the collector of transistor 36 and then referencing current source transistors 14, 16 and 18 to the former the currents in the respective collectors of the latter are set which eliminates any alpha related problems associated with base current errors. Thus, the collector currents of current source transistors 14, 16 and 18 track the thermal current flowing through transistor 36 with temperature variations.

A difference voltage is produced in the present invention by operating transistors 28 and 30 at different current densities, which as understood, generates a positive difference voltage $\Delta V_{BE}$ between the emitters of the two transistors. In the subject invention transistor 28 is operated at a lower current density than transistor 30 by making its emitter area N times larger than the emitter area of transistor 30 (where N is a positive number) and setting $I_1$ equal to $I_2$. If resistor 32 equals resistor 34, the voltage developed across the base-emitter of transistor 28 and resistor 32 will equal the voltage developed across the base-emitter of transistor 30 and resistor 34. However, since transistor 28 is operated at the lower current density its base-emitter voltage will be less than the base-emitter voltage of transistor 30 wherein at quiescence the aforementioned difference voltage is established between the emitters thereof. Initially, however, since transistor 28 sinks all of the current $I_1$ and is operated as a diode it will set the voltage to bias transistor 30. As the emitter of transistor 30 is (1/N) times smaller than the emitter of transistor 28 the former will initially sink a collector current less than the magnitude of $I_2$. This causes the collector voltage of transistor 30 to rise which turns on feedback transistor 46. Transistor 46 will then source base current drive to transistor 36 thereby rendering it conductive to sink a current, $I_T$, at its collector from the emitter of transistor 30 until the current flow through the latter equals the current $I_2$, which is equal to $I_1$. By forcing the current through transistor 30 to be equal to the current flow through transistor 28 the circuit feedback action produces the difference voltage $\Delta V_{BE}$ between the emitters thereof. This establishes the current $I_T$ sank by transistor 36. Thus, from the above it can be shown that in the quiescent operating condition:

$$I_1R_{32} + V_{BE28} = V_{BE30} + (I_2 - I_T)R_{34} \text{ and}$$

$$V_{BE30} - V_{BE28} = \Delta V_{BE}, \text{ then}$$

-continued $$\text{since } I_1R_{32} = I_2R_{34}$$

$$I_T = \Delta V_{BE}/R34:$$

$$\text{where } \Delta V_{BE} = (KT/q)\ln N;$$

$$K = \text{Boltzman's constant}$$

$$T = \text{Absolute temperature}$$

$$q = \text{electron charge}$$

Hence $I_T$ is a thermal current having a magnitude which can be controllably set by the value of R34 and which varies in direct relation to absolute temperature. NPN transistor 46 provides feedback current to bias the base of transistor 36 to ensure that it sinks the correct collector current. Transistor 46 also buffers the fan out base currents of current supply transistors 14, 16 and 18 from affecting the operation of transistors 28 and 30. Resistor 48 is selected to sink a current greater than the sum of the currents flowing through resistors 32 and 34 to assure proper bias current in transistor 46. By grounding the emitter of transistor 36 and coupling the bases of current source transistors 14, 16 and 18 to terminal 20, all of the collector currents of the latter will be thermal currents that vary as $I_T$ varies. These currents can be ratioed to have any desired magnitude by, for instance, utilizing emitter resistors or by emitter area ratioing. Thus, transistor 16 has resistor 49 in its emitter path and transistor 18 is shown as having multi-emitters. Thermal current source cell 12 is relatively independent to variations in the power supply voltage as the collector-emitter voltages of transistors 28 and 30 are well matched since the collector-base voltage of both transistors is substantially equal to zero.

Figure 2:
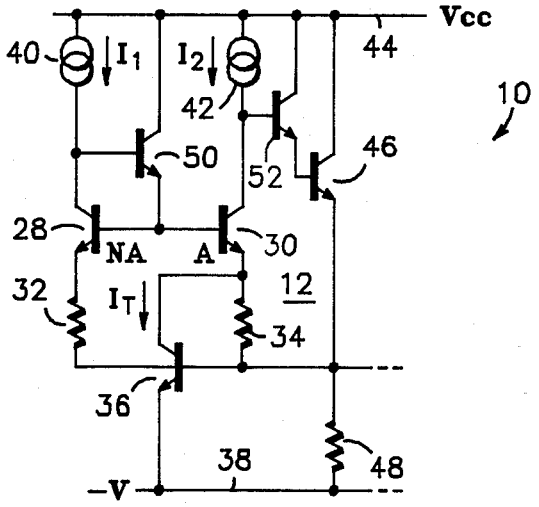
FIG. 2 is a schematic diagram of a second embodiment of the invention.

Referring to FIG. 2, a pair of NPN transistors 50 and 52 are shown which improve the precision of thermal current source 10. Transistor 50, which has its collector emitter path coupled between power supply conductor 44 and the bases of transistors 28 and 30 and its base connected to current source 40, buffers the base currents to the latter transistors to reduce error between $I_1$ and $I_2$. Similarly, transistor 52, with its collector-emitter path connected between power supply conductor 44 and the base of transistor 46 and its base connected to current source 42, buffers the base current of transistor 46.

Figure 3:
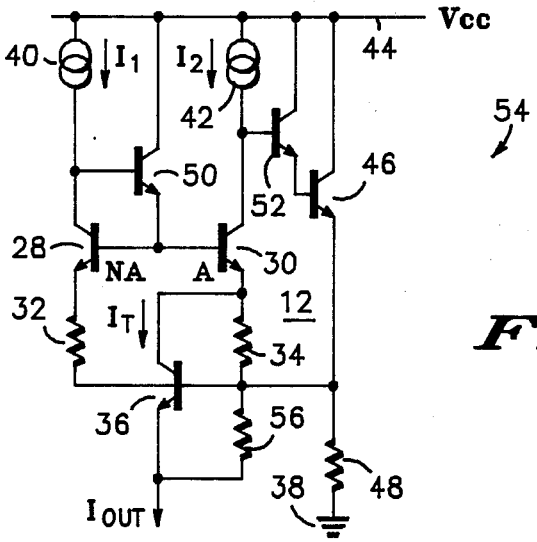
FIG. 3 is a schematic diagram of a third embodiment of the invention.

FIG. 3 shows a thermal current source 54 which provides an output current $I_{out}$ that has an adjustable temperature coefficient using the concepts disclosed above with respect to current source 10. Thermal current source 54 includes an additional resistor 56 coupled between the base and emitter of transistor 36 of reference cell 12. Iout is therefore equal to:

$$I_{out} = I_T + V_{BE36}/R56; \text{ and}$$

$$I_{out} = \Delta V_{BE}/R34 + V_{BE36}/R56,$$

where $V_{BE36}$ is the base-to emitter voltage of transistor 36; and

R56 is the value of resistor 56.

Since $\Delta V_{BE}$ has a positive TC and $V_{BE36}$ has a negative TC, selection of the ratio of R34 to R56 can set the TC of $I_{out}$ either positive, negative or even zero. It is understood that $V_{BE}$ of transistor 36 is well controlled as the collector current thereof is known to be $\Delta V_{BE}/R34$.

By way of example, resistors 32 and 34 have been illustrated above as being interconnected to the base of transistor 36. However, it is apparent from the present disclosure that resistors 32 and 34 could also be interconnected at a common node to any source of reference potential as long as transistor 30 is inhibited from becoming saturated. It is also understood that transistor 52 could be used to buffer transistor 46 as illustrated in FIG. 2.

Although several embodiments of the invention have been described above in detail, it is understood that modifications can be made thereto which will fall within the scope of the appending claims.

I claim:

1. A current supply, comprising:

first and second transistors having their bases coupled together and arranged to conduct currents through the respective collector-emitter conduction paths;

a third transistor having its collector conduction path coupled to the emitter of said second transistor;

first and second resistors arranged so that the current flowing through said first transistor also flows through said first resistor and a portion of the current flowing through said second transistor also flows through said second resistor; and feedback circuit means coupled between the collector of said second transistor and the base of said third transistor for providing a bias current to render said third transistor conductive to sink a current from said second transistor wherein the current flowing through said second transistor is ratioed to the current flowing in said first transistor thereby producing a voltage difference between said emitters thereof having a predetermined TC and said collector current of said third transistor having a regulated magnitude and said predetermined TC.

2. The current supply of claim 1 wherein the interconnection of said first and second resistors are connected to said base of said third transistor.

3. The current supply of claim 2 wherein said feedback circuit means includes:

a fourth transistor having an emitter coupled to said base of said third transistor, a collector coupled to a first power supply conductor, and a base coupled to the collector of said second transistor; and circuit means coupled between said emitter of said fourth transistor and a second power supply conductor for sinking a predetermined current from said fourth transistor.

4. The current supply of claim 3 including:

first conductive means for connecting the collector of said first transistor to said base thereof, the emitter area of said first transistor being N times larger than the emitter area of said second transistor where N is a positive number;

current source means for supply currents to the collectors of said first and second transistors; and second conductive means for connecting the emitter of said third transistor to said second power supply conductor and said base of the same to an output of the circuit.

5. The current supply of claim 4 including a fifth transistor having a base coupled to said collector of said second transistor a collector coupled to said first power supply conductor and an emitter coupled to said base of said fourth transistor.

6. The current supply of claim 4 wherein said first conductive means includes a fifth transistor having a base coupled to said collector of said first transistor a collector coupled to said first power supply conductor and an emitter coupled to said base of said first transistor.

7. The current supply of claim 6 including a sixth transistor having an emitter coupled to said base of said fourth transistor, a collector coupled to said first power supply conductor and a base connected to said collector of said second transistor.

8. The current supply of claim 1 including the collector of said third transistor being coupled to said emitter of said second transistor and the emitter coupled to an output of the circuit.

9. The current supply of claim 8 including:

a third resistor coupled between said base of said third transistor and said emitter thereof;

current supply means for supplying currents to the collectors of said first and second transistors; and said feedback means comprising a fourth tansistor having a base coupled to said collector of said second transistor a collector coupled to a first power supply conductor and an emitter coupled to said base of said third transistor and circuit means coupled between said emitter of said fourth transistor and a second power supply conductor for sinking a predetermined current therefrom.

10. The current supply of claim 9 including:

a fifth transistor having a base coupled to said collector of said first transistor a collector coupled to said first power supply conductor and an emitter coupled to said base of said first transistor; and said current flowing through said third transistor to said output of the circuit having a predetermined magnitude and temperature coefficient, said current flowing through said third transistor and said current flowing through said third resistor being summed together to provide a current at said output terminal having an adjustable temperature coefficient.

11. An integrated circuit including in combination:

first and second transistors having interconnected bases, said transistors being operated at different current densities to produce a difference voltage therebetween which has a predetermined temperature coefficient;

first and second resistors coupled in series between the emitters of said first and said second transistors, the interconnection therebetween being supplied a bias potential;

current supply means for supplying currents to the collectors of said first and said second transistors with the current flowing through said first transistor also flowing through said first resistor and a portion of the current flowing through said second transistor also flowing through said second resistor;

a third transistor having a collector-emitter path coupled to said emitter of said second transistor; and feedback circuit means coupled between the collector of said second transistor and said base of said third transistor for biasing the latter to sink current from said second transistor such that the magnitude of the collector current of said third transistor is set to a value proportional to said difference voltage, said collector current having a predetermined temperature coefficient that varies in relation to absolute temperature.

12. The circuit of claim 11 wherein said feedback circuit means includes:

a fourth transistor having an emitter coupled to said base of said third transistor, a collector coupled to a first power supply conductor and a base coupled to said collector of said second transistor; and a third resistor coupled between said emitter of said fourth transistor and a second power supply conductor.

13. The circuit of claim 12 including:

first conductive means for connecting said collector of said first transistor to said base thereof;

second conductive means connecting said emitter of said third transistor to said second power supply conductor; and said base of said third transistor being coupled to an output of the circuit.

14. The circuit of claim 13 wherein said interconnection of said first and second resistors is connected to said base of said third transistor.

15. The circuit of claim 14 wherein said first conductive means includes a fifth transistor having a base coupled to said collector of said first transistor an emitter connected to said base of said first transistor and a collector connected to said first power supply conductor.

16. The circuit of claim 15 including a sixth transistor having a base coupled to said collector of said second transistor an emitter connected to said base of said fourth transistor and a collector connected to said first power supply conductor.

17. The circuit of claim 12 including:

conductive means connecting said collector of said first transistor to said base thereof; and a fourth resistor coupled between said base and said emitter of said third transistor, said emitter of said third transistor being coupled to an output of the circuit.

* * * * *

UNITED STATES PATENT AND TRADEMARK OFFICE
CERTIFICATE OF CORRECTION

PATENT NO. : 4,677,368

DATED : June 30, 1987

INVENTOR(S) : Byron G. Bynum

It is certified that error appears in the above-identified patent and that said Letters Patent is hereby corrected as shown below:

Column 6, claim 9, line 21, delete "tansistor" insert --transistor--.

Signed and Sealed this

Twenty-sixth Day of December, 1989

*Attest:*

JEFFREY M. SAMUELS

*Attesting Officer*

*Acting Commissioner of Patents and Trademarks*